United States Patent [19]

Pitt

[11] Patent Number: 4,929,201

[45] Date of Patent: May 29, 1990

[54] VARIABLE PITCH MARINE PROPELLER SYSTEM

[75] Inventor: Donald R. Pitt, Murray, Utah

[73] Assignee: Vari-Prop, Inc., Salt Lake City, Utah

[21] Appl. No.: 34,718

[22] Filed: Apr. 6, 1987

[51] Int. Cl.[5] ..... B63H 3/00

[52] U.S. Cl. ..... 440/50; 416/147; 416/159; 416/244 B

[58] Field of Search ..... 440/50, 66, 78; 416/147, 153, 154, 159, 167, 244 B

[56] References Cited

U.S. PATENT DOCUMENTS

| | | | |
|---|---|---|---|
| 2,742,097 | 4/1956 | Gaston | 440/50 |
| 2,850,106 | 9/1958 | Swan | 440/50 |
| 2,931,443 | 4/1960 | Pehrsson | 440/50 |
| 2,955,659 | 10/1960 | Daley | 440/50 |
| 3,138,136 | 6/1964 | Nichols | 440/50 |
| 3,151,597 | 10/1964 | Larsen | 440/78 |

*Primary Examiner*—Joseph F. Peters, Jr.
*Assistant Examiner*—Stephen P. Avila
*Attorney, Agent, or Firm*—Marcus G. Theodore

[57] ABSTRACT

A variable pitch marine propeller comprising two removable symmetrical propeller blades with cylindrical bases each having a drive lug attached proximate the driving edge of the point of attachment of each blade. A coupling are associated with the drive lugs of the bases and structured to hold the blades by the bases to align and simultaneously rotate the pitch of the blades in equal and opposite directions in response to movement of the coupling. A hub sub-assembly encases the coupling and bases of the blades to allow the blades to pivot and assume a forward or rearward pitch. The hub sub-assembly has a front end, and a rear end capable of mounting onto a drive shaft. A spring is associated with the coupling to initially position said coupling in a position which holds the blades in a rear pitch configuration. A hydraulic piston system is associated with the coupling means to provide a predetermined fixed pressure on said coupling to alter the spacing pressure and move the coupling to a position which causes the blades to assume the desired forward or rearward blade pitch.

11 Claims, 5 Drawing Sheets

VARIABLE PITCH MARINE PROPELLER SYSTEM

FIELD

This invention relates to variable pitch propellers. More particularly, it relates to a variable pitch marine propeller system which adjusts the pitch of the blades in relationship to the demands placed on the engine.

STATE OF THE ART

Various variable pitch propeller systems are known. The airline industry has employed variable pitch propeller systems for years. These air adjustable pitch propeller systems have large hubs which do not function when applied under marine conditions, because the more viscous aqueous media creates extreme stresses on these air adjustable pitch propeller systems. Further, the large airline hub, even when scaled down, creates too much torque to enable variable pitch air propeller systems to properly function. Also, the air adjustable pitch propeller systems have elaborate gearing which requires complicated shielding from water to prevent fouling and undue wear.

To adapt a variable pitch propeller to marine conditions, various worm gear and complex drive systems have been tied. These complex drive systems are often fouled by water corrosion. When these variable pitch propellers encounter an object, or are bumped, extreme stress is placed on the propeller system causing internal damage which usually requires extensive repairs. These variable pitch marine propeller systems also do not provide a propeller pitch range allowing the blades to be varied from a reverse to forward pitch. They also employ elaborate gearing systems, which do not adjust the pitch in response to the load demands placed on the engine. Consequently, conventional marine variable pitch propeller systems place extreme loads on the engine when starting, and do no automatically adjust to provide optimal higher pitches when cruising for more efficient engine operations.

There thus remains a need for a variable pitch marine propeller system which allows the blade to vary its pitch from reverse to forward, and which minimizes the strain placed on the engine over its operating range. Applicant's invention described below provides such an invention.

SUMMARY OF THE INVENTION

The invention comprises two symmetrically mounted propeller blades, each having cylindrical bases. The bases of the propeller blades are journal mounted within a mounting hub sub-assembly to enable the blades to rotate and pivot. The mounting hub sub-assembly is openable and surrounds a coupling associated with the bases of the blades to allow said blades to pivot in opposite directions.

Molded bearings constructed of an inert material, such as teflon, are associated with each base to allow the bases to freely turn within the mounting hub sub-assembly. These molded bearings are lubricated by water and prevent the bases from fouling within the hub sub-assembly.

A propeller blade drive lug is attached to each base proximate the driving edge of each blade. The coupling, preferably configured as a slide block with vertically aligned holes, is slideably mounted within the hub sub-assembly and associated with the drive lugs to align and hold said blades at the proper pitch. When activated, the coupling moves back and forth and rotates the bases in equal and opposite rotation to simultaneously vary the pitch of both blades. The propeller blades are initially held in reverse pitch when no pressure is applied to move the coupling from its most rearward position. This is accomplished by biasing the slide block coupling in its most rearward position with biasing means, such as a spring associated with the hub sub-assembly. The blade drive lugs are thus initially held in their most rearward position as the slide block is held back against the mounting hub sub-assembly. The drive lugs are preferably constructed as cylinders which fit in the holes in the slide block and provide a large pivoting surface to prevent the blades from binding as the coupling varies the pitch.

The mounting hub sub-assembly has a front end onto which is mounted a shock nose cone constructed of an impact absorbing material, such as rubber, to take the first impact if accidental contact occurs. Preferably the nose cone simply snap mounts onto the front of the mounting hub sub-assembly. The rear end of the hub sub-assembly is adapted to attach to the drive shaft of an outdrive motor.

Drive means, such as a hydraulic piston drive, are associated with the coupling to move the coupling back and forth. The movement of the coupling simultaneously moves the drive lugs to tilt both blades to the desired pitch.

A hydraulic circuit is associated with the piston drive, and preferably includes pressure regulator means, such as a spring biasing or air cushion system. This pressure regulator prevents the pressure within the circuit from exceeding a predetermined pressure set by the user. This cushioning of the pressure buildup within the hydraulic circuit prevents excessive pressures within the hydraulic system when extreme loads are encountered by the propeller. The regulator thus provides automatic pressure reduction within the hydraulic circuit to retract the slide block and reduce the pitch of the blade. As the pitch of the blade is reduced, the friction loads placed on the propeller are reduced to prevent excessive engine loads. For example, when a boat is first started, it lies at its deepest point within the water and provides the greatest loads on the propeller. As the boat moves forward, less load is placed on the propeller. Therefore, to optimize engine efficiency, matching load characteristics are required. The blade pitch should therefore be lowest when starting a boat, and then increased as the boat moves forward. Because applicant's variable propeller system initially starts with the blades in a biased rear pitch position, the operator directs pressure within the hydraulic circuit to move the propeller pitch to a forward position. The propeller pitch is then tilted forward until the pressure within the hydraulic drive reaches maximum pre-set pressure. The blades then start to move the boat forward. As the boat moves forward, its starts to lift out of the water. The vertical lift of the boat reduces the drag load placed on the propeller. As the load placed on the propeller decreases, the hydraulic pressure drive automatically increases the propeller pitch until the maximum pre-set pressure is again achieved. Thus, as the forward speed of the boat increases, the loads placed on the propeller decrease so that the hydraulic line pressure forces the blades to assume an even greater forward pitchy; thereby propelling the boat faster and higher out of the water. The self adjusting propeller pitch insures that loads placed on the engine do not exceed a predetermined load factor.

For optimal operations, the engine speed is pre-set for optimal performance. The hydraulic circuit pressure limiting means are then pre-set to insure that the propeller pitch will not place excessive load strain on the engine to interfere with the optimal engine performance. Because of this self-regulating propeller adjustment feature, excessive engine loads are minimized and optical engine performance and boat speeds are achieved with minimal fuel consumption.

Although in most operations the hydraulic line pressures limits are pre-set, a manual over-ride may be included to enable the operator to reduce or increase the pressure within the hydraulic lines. This enables the operator to manually set the desired load operating requirements for the propeller. Alternatively, pressure sensing means may be associated with the hydraulic drive system to automatically vary the propeller pitch in relationship to the engine performance requirements to optimize engine performance.

The hydraulic system incorporates a line pressure regulator such as an auto power steering pump. The minimum pressure within the line is set in excess of 120–150 p.s.i. to over come the spring resistance of 10 lbs./inch. To operate a typical outboard drive motor, the line pressure is set at 140 p.s.i. However, a manual over-ride allows the pressure to be varied from 0 p.s.i. to 140 p.s.i.

Preferably the blades are made of a weaker material than the mounting hub sub-assembly parts. In this manner the blades will break before the other parts. The damaged blades can then be repeatedly replaced, without having the additional expense of replacing the more expensive hub sub-assembly and coupling parts. For example, the hub sub-assembly can be made of a light weight metal, such as steel or aluminum, and the blades can be made of aluminum or nylon. Blade replacement is accomplished by removing the shock nose, opening the hub sub-assembly, and replacing the worn out blade. As both are symmetrical, only one design of blade is needed for replacement. Further, the blades can be interchanged and rotated, if desired.

The optimal pitch on the blades is approximately a 12 forward pitch (12 inches/rotation) when the blades are held in the full forward position. When held in the full rear position, the pitch is approximately a 5° reverse pitch. These blades may be die cast or molded in various shapes to meet the operating performances desired by a user. The 12 pitch provides almost the same high speed operation characteristics as a 14 pitch, but allows the propeller to function better at lower variable pitch settings.

The curve of the tips of the blades are shaped to provide continuous positive loading against the drive over the range of operation of the propeller to prevent drift. By maintaining continuous positive loading, the drive, when activated, provides direct response without flutter or vibration.

In operation, the blades initially spring to a forward pitch when the drive shaft is engaged. The degree of forward pitch actually assumed by the propeller is dependent upon the load resistance encountered, as described above. Reverse pitch is achieved by positioning the hydraulic cylinder in its most rearward position, thereby securing the propeller in the reverse pitch position. The operator may manually adjust the hydraulic line pressure to fix the pitch of the blades, or the hydraulic line pressure may be pre-set to adjust automatically in response to the propeller loads encountered at optimal engine performance.

It is also possible to use applicant's variably pitch propeller on a conventional drive shaft where the user is interested in periodically varying the pitch of a fixed blade propeller. In this fixed blade configuration the variable pitch marine propeller system comprises two removable propeller blades with cylindrical bases having a drive lug attached proximate the driving edge of the point of attachment of the blade. Coupling means are associated with the drive lugs of the bases to align and hold said blades by their bases and simultaneously rotate the pitch of said blades in equal and opposite directions. A hub sub-assembly encases the coupling means and bases of the blades to allow said blades to pivot and assume a forward or rearward pitch in response to the movement of the coupling means. The coupling means has a rear end end capable of mounting onto a drive shaft; and locking means associated with the coupling means to lock the pitch of the propeller blades at a predetermined pitch selected by a user. Preferred locking means comprise a plurality of holes in the coupling means. A corresponding hole is located in the hub sub-assembly in passing alignment with the holes in the coupling means. A removable locking pin sized to be inserted in the aligned holes of the coupling means and hub sub-assembly is inserted to secure the coupling in the desired position set by a user, and thereby fix the blade pitch. When the operator desired to change the blade pitch, the locking pin is removed, and the blades are rotated to the desired pitch. The locking pin is the re-inserted to fix the blade pitch.

Applicant's nvention thus provides a variable pitch marine propeller which can assume both forward and rearward drive, while optimizing engine performance.

DESCRIPTION OF THE ILLUSTRATED EMBODIMENTS

Figure 1:
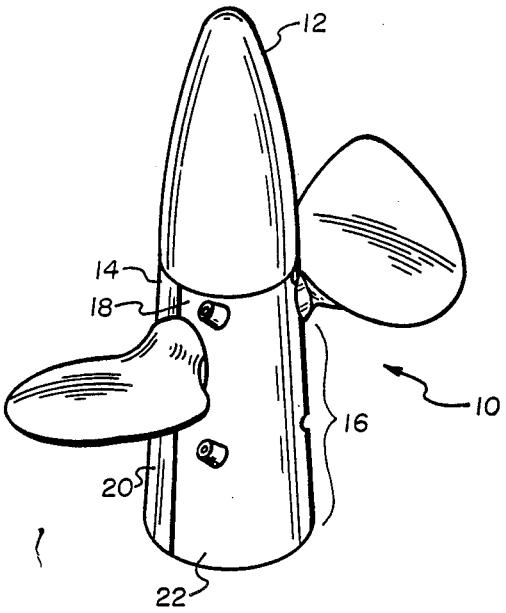
FIG. 1 is a perspective view of one embodiment of the invention.
Figure 2:
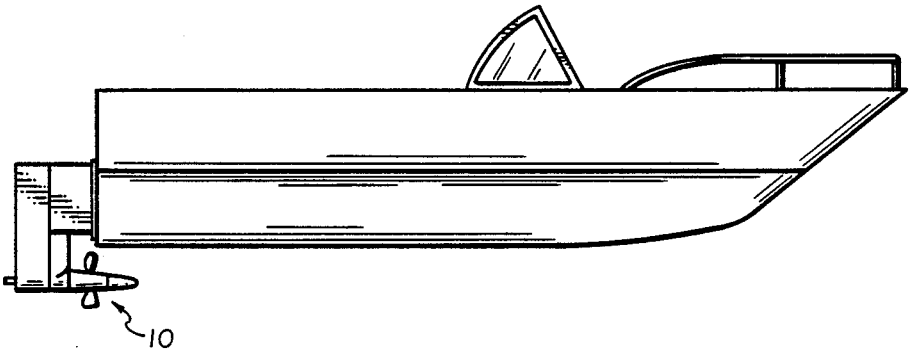
FIG. 2 is a perspective view of the embodiment of the invention attached to a board outdrive engine.

FIG. 1 illustrates a perspective view of one preferred embodiment of applicant's invention 10. The reversible propeller 10 is designed for use with the outdrive motor of a boat, as shown in FIG. 2. A medium hard rubber shock nose cone 12 is snapped onto the front end 14 of the hub sub-assembly 16. The hub sub-assembly 16 comprises a front casing 18, and a rear hub casing 20 longitudinally joined together. The front hub casing 18 is removably held to the rear hub casing 20 with four bolts (not shown) passing through corresponding holes in the front and rear hub casing 18, 20 to secure both members together. The bottom of the front and rear hub casing 16, 18, forms a flange 22 which attaches to the drive shaft.

Figure 3:
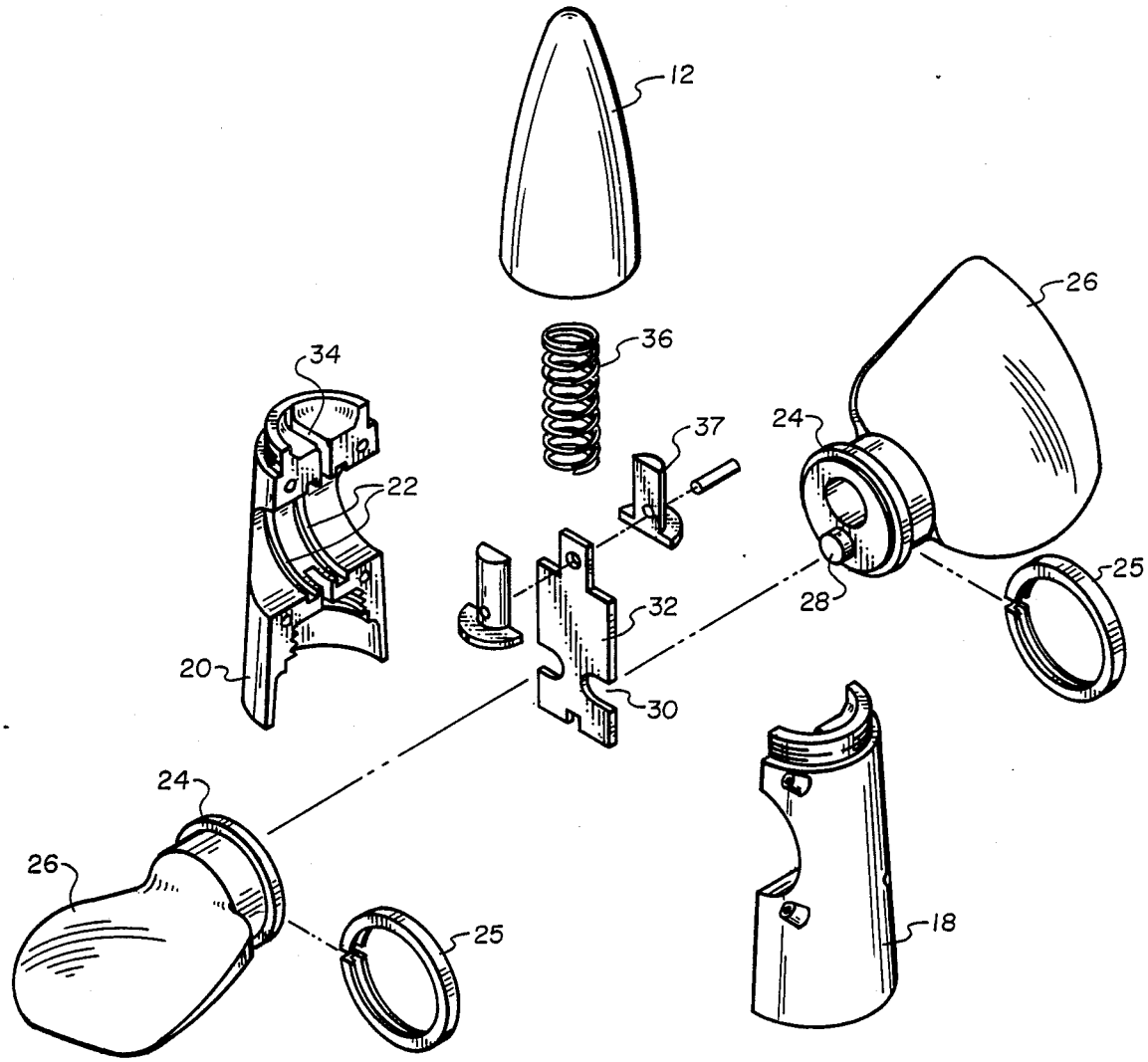
FIG. 3 is an exploded view of the embodiment of the invention shown in FIG. 1.

As shown if FIG. 3, the front and rear hub casings 18, 20 have internal grooves 22 structured to accommodate and allow the cylindrical bases 24 of the two propeller blades 26 to insert therein and turn when mounted in horizontal alignment. Around each cylindrical base 24 is a molded teflon bearing 25, which allows the blades 26 to turn smoothly; even when under load. Although teflon is preferred, other inert materials which are lubricated by water, may be used. Teflon has the additional feature of being impervious to salt water.

The two piece hub sub-assembly 16 separates between the front and rear hub casings 18, 20 to allow the replacement of the blades 26. The hub sub-assembly parts 18, 20 are preferably made of light weight strong metals, plastic resins, nylons, or other alloy materials resistant to salt water corrosion.

Attached to each cylindrical base 24 of the propeller blade 26 is a large cylindrical blade drive lug 28 proximate the driving edge of the blade 26. The lugs 28 are rotatably seated in vertically aligned corresponding slots 30 in a sliding block coupling 32 slideably mounted between the bases 24 in a groove 34 in the hub sub-assembly 16 which allows it to move forward and backward. The vertically aligned slots 30 insure proper orientation of the edge of each blade 26. As the sliding block coupling 32 moves backward and forward, the drive lugs 28 equally rotate the blades 26 in equal and opposite directions to symmetrically vary the pitch of the blades 26.

Figure 4:
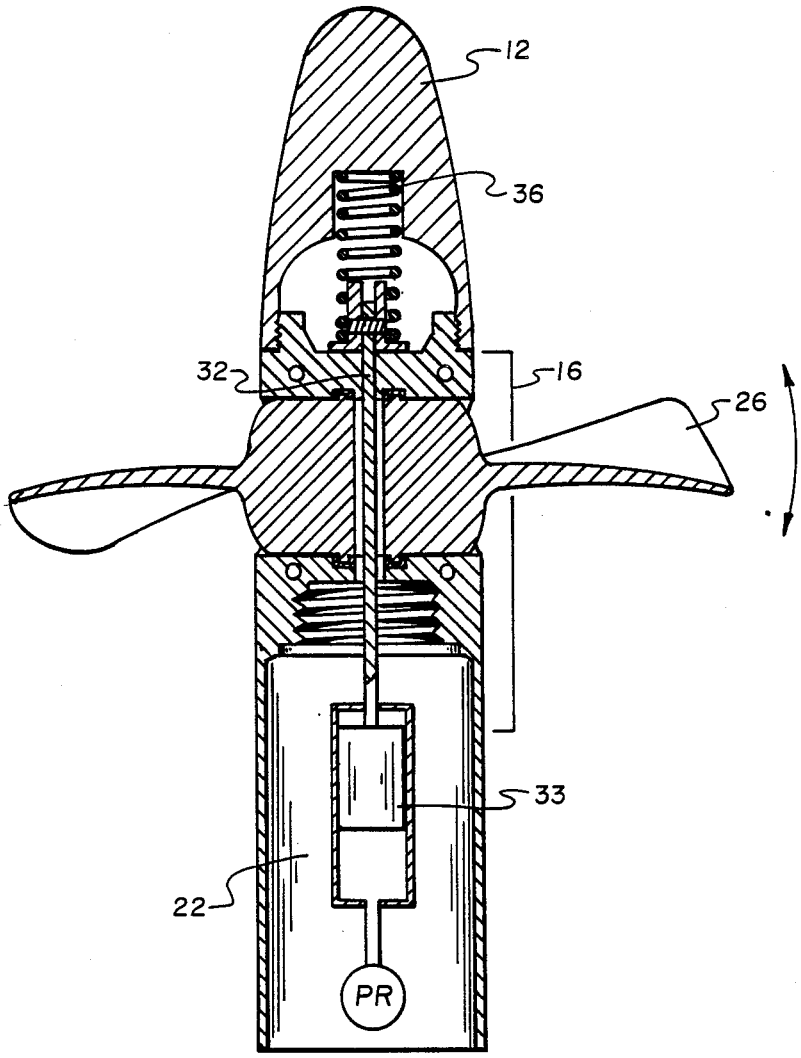
FIG. 4 is a cross sectional view of the embodiment of the invention shown in FIG. 1.

A shaft (not shown) is attached to the rear of the sliding block coupling 32 and extends beyond the sub-assembly 16 into a hydraulically operated cylinder 33 shown in FIG. 4 to move the sliding block coupling 32 back and forth.

A spring 36 mounted in a groove (not shown) in the nose cone 12 and secured to the slide block coupling 32 via a keeper 37 to initially force the slide block coupling 32 in its most rearward position back against the end of groove 34 in the mounting hub sub-assembly 16. This orientation in turn rotates the blade drive lugs 28 to hold initially the blades 26 in a rearward position. As the hydraulically operated cylinder 33 drives the shaft to move the coupling 32 forward by overcoming the spring biasing, the blade drive lugs 28 force the blades 26 to rotate and assume a forward pitch. Conversely, as the drive shaft 32 secures the coupling 32 in a rearward position, the blade drive lugs 28 hold the blades 26 in a rearward pitch. By activating the slide block coupling 32, the pitch of the blades 26 is allowed to assume a forward or rearward pitch selected by the user.

FIG. 4 illustrates a cross-sectional view of applicant's invention 10, showing the blades 26 initially biased in a reverse position by the spring 36 located in the nose cone 12 screwed on the housing sub-assembly 16. As illustrated, the blades 26 are angled to form a 12 pitch in the full forward position. The bottom 22 of the housing sub-assembly 16 is flanged and threaded to attach to an engine outdrive shaft (not shown). Mounted within the engine outdrive shaft is a hydraulically activated piston 33 associated with an adjustable pressure regulator.

Figure 5:
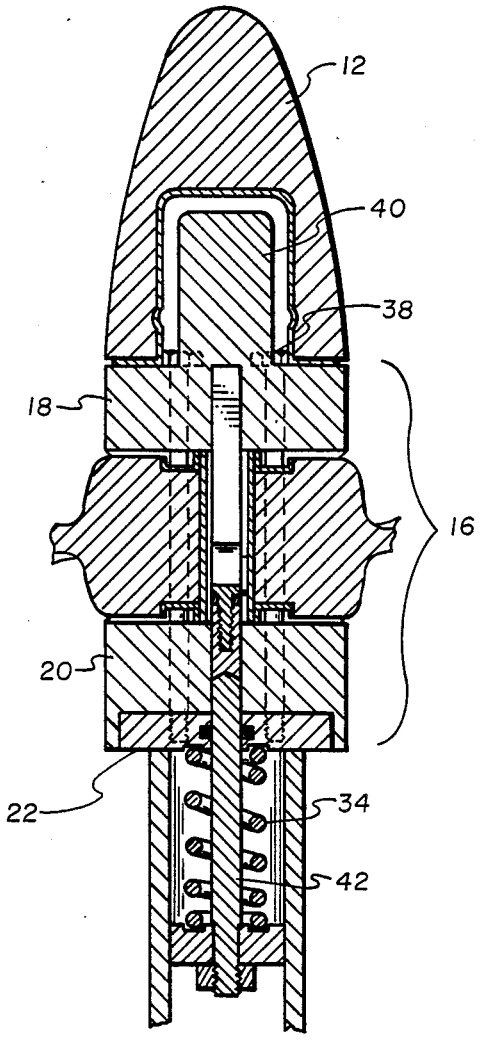
FIG. 5 is a cross sectional view of the mounting sub-assembly of another preferred embodiment.

FIG. 5 illustrates a cross-sectional view of another preferred embodiment of applicant's invention 10 with the spring 34 located behind the hub sub-assembly 16. In this embodiment, the hub sub-assembly 16 comprises a front and rear sub-assembly 18, 20 which separate along a horizontal line. The front and rear sub-assembly 18, 20 are held together by four bolts 38. The front sub-assembly 18 has a snap mount 40 onto which the nose cone 12 snaps. The spring 34 is located behind the bottom 22 of the hub sub-assembly 16 to drive a pull rod 42 attached to the coupling 32 rearward and initially hold the coupling in a rearward position.

Figure 6:
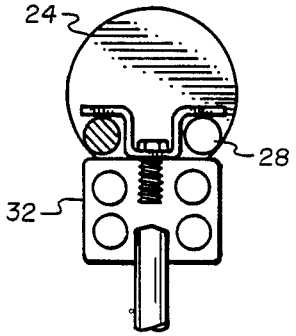
FIG. 6 is a cross sectional view of a preferred coupling.

FIG. 6 illustrates another preferred coupling 32 configuration designed to simultaneously rotate the drive lugs 28 in equal and opposite directions to rotate the bases 24.

Figure 7:
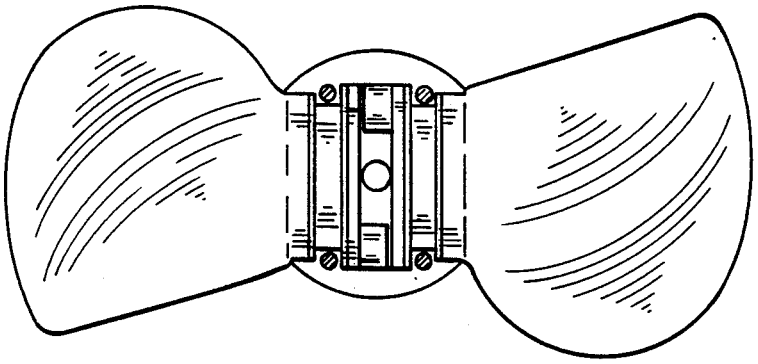
FIG. 7 is a top view of the propeller blades coupled together.

FIG. 7 illustrates a top perspective view of the blades 24 held by the coupling 32 configuration shown in FIG. 6. The curve of the tips of the blades 24 are shaped to provide continuous positive loading against the drive over its operating range to prevent drift. By maintaining continuous positive loading, the drive, when activated, provides direct response without flutter or vibration.

Figure 8:
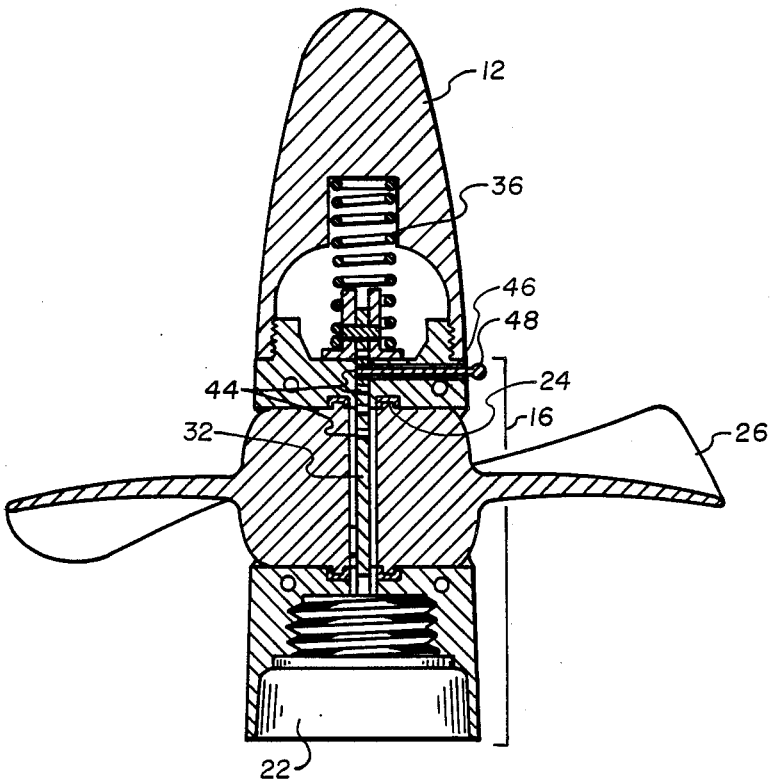
FIG. 8 is a cross sectional view of a propeller with the blade set at a fixed pitch.
Figure 9:
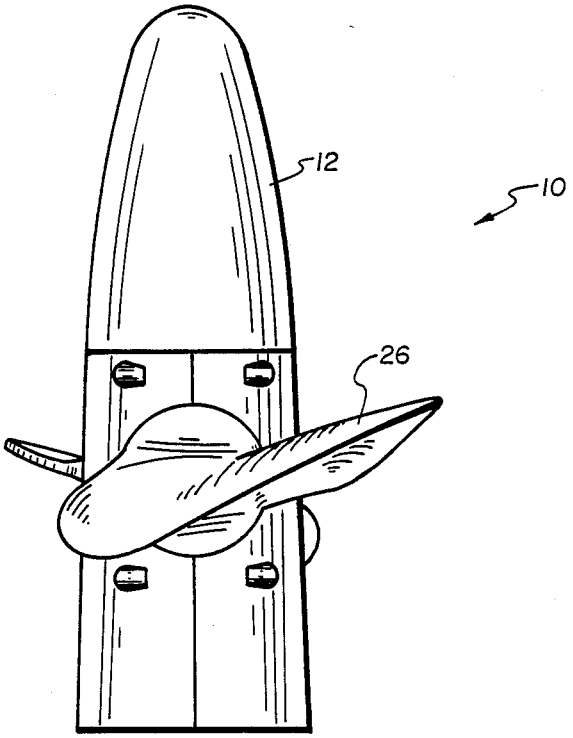
FIG. 9 is a perspective view of the embodiment shown in FIG. 8.

FIG. 8 illustrates an embodiment of applicant's variably pitch propeller 10 which can be used with a conventional drive shaft. In this configuration the variable pitch marine propeller 10 comprises two removable propeller blades 26 with cylindrical bases having a drive lug 28 attached proximate the driving edge of the point of attachment of the blade 26. A coupling sliding bar 32 is associated with the drive lugs 28 of the bases 24 to align and hold said blades 26 by their bases 24 to simultaneously rotate the pitch of said blades 26 in equal and opposite directions as the bar 32. The hub sub-assembly 16 encases the coupling sliding bar 32 and bases of the blades 26 to allow said blades 26 to pivot and assume a forward or rearward pitch in response to the movement of the coupling means. The coupling sliding bar 32 has a plurality of holes 44. A hole 46 in the hub sub-assembly 16 is in passing alignment with the holes 44 in the sliding bar 32 as said bar 32 is moved. A removable threaded pin 48 passes through the hole 46 of the hub sub-assembly 16 and into a desired hole 44 of the sliding bar 32 to lock the pitch of the propeller blades 26 at the desired pitch selected by a user. The pin 48 is then removably secured through the holes by screwing into the hub sub-assembly 16.

Although this specification has made reference to the specific embodiments, it is not intended to restrict the scope of the appended claims. The claims themselves recite those limitations required of the invention.

I claim:

1. A variable pitch marine propeller system comprising: two removable symmetrical propeller blades with cylindrical bases each having a drive lug attached proximate the driving edge of the point of attachment of each blade, a sliding block activated by drive means mounted between the bases of the propeller with vertically aligned slots into which the drive lugs are inserted to hold said blades by the bases to align and simultaneously rotate the pitch of said blades in equal and opposite directions in response to movement of the sliding block;

a hub sub-assembly encasing the coupling means and bases of the blades and structured to journal mount and allow said blades to pivot and assume a forward or rearward pitch, and having a front end, and a rear end capable of mounting onto a drive shaft;

biasing means associated with the coupling means to initially position said coupling means in a position which holds said blades in a rear pitch configuration; and drive means associated with the sliding block to provide a predetermined fixed pressure on said sliding block to alter the biasing means pressure and move said sliding block to a position which causes the blades to assume the desired forward or rearward blade pitch.

2. A variable pitch marine propeller system according to claim 1, including: inert friction reducing bearings mounted within the cylindrical grooves around the bases of the propellers and the hub sub-assembly grooves to enable said bases to turn when subjected to load stresses, and prevent said bases from corroding or fouling within the groove.

3. A variable pitch marine propeller system according to claim 1, wherein the drive means comprise a hydraulically activated piston associated with the sliding block to move said sliding block forward or backward and alter the pitch of the blades.

4. A variable pitch marine propeller system according to claim 1, wherein and the biasing means comprise a spring mounted in the hub sub-assembly and associated with the sliding block to initially force the sliding block in a rearward position and hold the propeller blades in a rear pitch position until overcome by the force applied by the drive means.

5. A variable pitch marine propeller system according to claim 1, including a nose cone constructed of a shock absorbing material attached to the front end of the housing.

6. A variable pitch marine propeller system according to claim 3, including an adjustable pressure regulator associated with the hydraulic cylinder to prevent the pressures within the hydraulic lines from exceeding a predetermined limit.

7. A variable pitch marine propeller system according to claim 1, wherein the hub sub-assembly is openable to enable the removal and replacement of each blade.

8. A variable pitch marine propeller system comprising:

two removable propeller blades with cylindrical bases each having a drive lug attached proximate the driving edge of the point of attachment of each blade, a sliding block activated by drive means mounted between the bases of the propeller with vertically aligned slots into which the drive lugs are inserted to align and hold said blades by the bases to simultaneously rotate the pitch of said blades in equal and opposite directions in response to movement of the sliding block;

a hub sub-assembly encasing the sliding block and into which the bases of the blades are journal mounted to allow said blades to pivot and assume a forward or rearward pitch in response to the movement of the sliding block, and having a front end, and a rear end capable of mounting onto a drive shaft; and locking means associated with the coupling means to lock the pitch of the propeller blades at a predetermined pitch selected by a user.

9. A variable pitch marine propeller according to claim 8, wherein the locking means comprise:

a plurality of holes in the sliding blade, corresponding holes in the hub sub-assembly along the loci of the path of the sliding blade, and a removable pin sized to be inserted in aligned holes of the sliding blade and hub sub-assembly to secure the coupling in the desired position set by a user and thereby fix the position of the blade pitch.

10. A variable pitch marine propeller system comprising:

two removable symmetrical propeller blades with cylindrical bases each having a drive lug attached proximate the driving edge of the point of attachment of each blade, a sliding block activated by drive means mounted between the bases of the propeller with vertically aligned slots into which the drive lugs are inserted to align and hold said blades by the bases to align and simultaneously rotate the pitch of said blades in equal and opposite directions in response to movement of the sliding block;

an openable hub sub-assembly encasing the coupling means and sliding block and into which the bases of the blades are journal mounted to allow said blades to pivot and assume a forward or rearward pitch, and having a front end, and a rear end capable of mounting onto a drive shaft;

inert friction reducing bearings mounted within cylindrical grooves around the bases of the propellers and the hub sub-assembly grooves to enable said bases to turn when subjected to load stresses, and prevent said bases from corroding or fouling within the groove, a spring mounted in the hub sub-assembly and associated with the sliding block to initially position said sliding block in a rearward position and hold said blades in a rear pitch configuration until overcome by the force applied by a piston;

an hydraulically activated piston associated with the sliding block to provide a predetermined fixed pressure on said coupling means to alter the spring pressure and move said sliding block to a position which causes the blades to assume the desired forward or rearward blade pitch, a nose cone constructed of a shock absorbing material attached to the front end of the housing, and an adjustable pressure regulator associated with the hydraulic cylinder to prevent the pressures within the hydraulic lines from exceeding a predetermined limit.

11. A variable pitch marine propeller system comprising:

two removable propeller blades with cylindrical bases each having a drive lug attached proximate the driving edge of the point of attachment of each blade, a sliding block activated by drive means mounted between the bases of the propeller with vertically aligned slots into which the drive lugs are inserted to align and hold said blades by the bases to simultaneously rotate the pitch of said blades in equal and opposite directions in response to movement of the sliding block;

a hub sub-assembly housing encasing the sliding block and into which the bases of the blades are journal mounted to allow said blades to pivot and assume a forward or rearward pitch in response to the movement of the sliding block, and having a front end, and a rear end capable of mounting onto a drive shaft, said hub sub-assembly housing having a plurality of holes corresponding to holes in the sliding block along the loci of the path of the sliding block; and a removable pin sized to be inserted in aligned holes of the coupling means and hub sub-assembly housing to secure the sliding block in the desired position set by a user and thereby fix the position of the blade pitch.

* * * * *